United States Patent [19]

Stangroom

[11] Patent Number: 4,812,251

[45] Date of Patent: Mar. 14, 1989

[54] ELECTRO-RHEOLOGICAL FLUIDS/ELECTRIC FIELD RESPONSIVE FLUIDS

[75] Inventor: James E. Stangroom, Sheffield, Great Britain

[73] Assignee: ER Fluid Developments Limited, Sheffield, England

[21] Appl. No.: 168,664

[22] Filed: Mar. 16, 1988

[30] Foreign Application Priority Data

Mar. 24, 1987 [GB] United Kingdom ..... 8706928

[51] Int. Cl.[4] ..... C09R 3/00; C10M 107/50

[52] U.S. Cl. ..... 252/75; 252/49.6; 252/58; 252/74; 252/78.3; 252/572; 252/573

[58] Field of Search ..... 252/49.6, 58, 74, 75, 252/78.3, 572, 573; 556/452

[56] References Cited

U.S. PATENT DOCUMENTS

| | | | |
|---|---|---|---|
| 3,047,507 | 7/1962 | Winslow | 252/74 |
| 3,660,453 | 5/1972 | Groenhof et al. | 252/78.3 |
| 4,033,892 | 7/1977 | Stangroom | 252/76 |
| 4,483,788 | 11/1984 | Stangroom et al. | 252/74 |
| 4,645,614 | 2/1987 | Goossens et al. | 252/75 |

*Primary Examiner*—Robert A. Wax

*Attorney, Agent, or Firm*—Trexler, Bushnell, Giangiorgi & Blackstone, Ltd.

[57] ABSTRACT

An electro-rheological fluid comprising a hydrophilic solid and a hydrophobic liquid component wherein the hydrophobic liquid component comprises a fluorosilicone whose average molecular weight is in the range 200–700.

19 Claims, No Drawings

ELECTRO-RHEOLOGICAL FLUIDS/ELECTRIC FIELD RESPONSIVE FLUIDS

This invention relates to so-called electrorheological (ER) fluids, which are also known as electric field responsive fluids.

ER fluids were first described by Winslow in 1947, and have since been the subject of several patents. ER fluids are slurries of finely divided solids in a base liquid which have the property of increasing their flow resistance when they are exposed to an electric field. This change is roughly proportional to the electric field, reversible and virtually instantaneous. Although the voltages employed are high (typically up to 4 kV/mm), the total electric power is very low, so ER fluids offer a valuable interface between solid-state electronic control and a very wide range of mechanical devices.

A wide range of solid materials have been used to make ER fluids. Winslow used silica gel; more recently, ionic polymers, such as alginic acid, polymethacrylic acid and phenolformaldehyde resins have been used, usually as salts. Similarly, a wide range of base liquids have been used. Winslow's original ER fluids were based on hydrocarbon transformer oil. More recently, synthetic halogenated materials have been used.

It is well known from prior art that the minimum requirement for a base liquid for an ER fluid is that it shall be hydrophobic, i.e., totally immiscible with water: experimental evidence strongly suggests that the ER effect is due to water adsorbed into the solid particles. However, not all hydrophobic liquids are equally suitable for use in ER fluids. Desirable features are:

(1) The base liquid must make as active an ER fluid as possible. The activity (i.e., the extent of the change in flow properties brought about by application of an electric field) of ER fluids made with the same solid and different base liquids varies markedly. Clearly, it is desirable that the final ER fluid should be as active as possible.

(2) The density of the base liquid should be as nearly equal as possible to that of the solid, to prevent the latter settling out. The density of the solids used in most ER fluids at present is about 1400k9/cu.m, so this should be regarded as an approximate target for the density of the base oil.

(3) The base liquid should be chemically stable in the special circumstances of an ER fluid, so that the material has a long service and shelf life.

(4) The base liquid should have a wide liquid temperature range i.e. a low freezing point and a high boiling point.

(5) The base liquid should not be flammable, or at least burn only with difficulty.

(6) The base liquid should have a low viscosity, so that the no-field viscosity of the ER fluid itself is low.

(7) The base liquid should not attack normal engineering materials. Relatively few liquids attack metals in normal use, but many attack plastics, and particularly the elastomers used in oil seals. This is clearly undesirable in a fluid which will be used in engineering.

(8) The base liquid should be an effective lubricant in its own right.

(9) The base liquid should not have any adverse biological effects.

(10) Ideally, the base liquid should be odourless; there is a natural suspicion among potential users of unfamiliar smells, and many people are very sensitive to them.

None of the base liquids so far proposed for ER fluids meet all these criteria. Among these are:

(a) Hydrocarbons. These were used by Winslow. They give relatively inactive ER fluids, and have too low a density (800 kg/cu.m). Lighter grades tend to be noticeably volatile and flammable. They have a noticeable smell, but this is not unpleasant and relatively familiar.

(b) Halogenated Aromatic Hydrocarbons. These make very active ER fluids. Polychlorinated biphenyls (PCB's) were used initially but were abandoned when their highly carcinogenic and mutagenic properties became known. Later developments were:

(i) Halogenated diphenyl methanes. (and related compounds). These appear to be less mutagenic than the PCB's and have a suitable density. The liquid range can be extended, and the viscosity reduced, by mixing suitable related compounds. Materials chemically related to the PCB's such as these are inevitably suspect as regards, biological activity; not all have been tested. All these liquids attack normal engineering elastomers; only materials such as 'Viton' can be used.

(ii) Halogenated mixed ethers. These were developed in an attempt to make a cheaper version of (i) above, with a longer liquid range. Typically, these have a highly halogenated aromatic 'head', such as pentachlorophenyl, and an aliphatic 'tail', such as N-octyl. These have many of the advantages and disadvantages of the diphenyl methanes.

(iii) Halogenated aliphatic hydrocarbons. Attempts have been made to use, for example, chlorinated paraffins in ER fluids. These can give active fluids, and are regarded as much less dangerous biologically than the aromatic compounds. However, it is well known that such compounds undergo slow hydrolysis under alkaline conditions, liberating hydrochloric acid. The solids in ER fluids are normally salts of a strong base (e.g., lithium hydroxide) and a weak acid, and are therefore alkaline; they also contain adsorbed water. Furthermore, the large surface area of the solid provides an ideal surface for such reactions to take place. These materials are therefore suspect in service and storage.

Most of the halogenated hydrocarbons are either non-flammable or burn only with difficulty. Many have strong and unpleasant smells to which many people are sensitive, and some have noticeable anaesthetic properties, which could be dangerous in a confined space.

Fluorinated Materials

Three types of fluorinated liquids are now available commercially at reasonable cost. These are:

A. Perfluorinated Polyethers A typical example is "Fomblin" supplied in various grades by Montedison. These are very dense (typically 1800–1900 kg/cu.m), and immiscible with everthing except other fluorinated materials such as Freons. Attempts to use these in ER fluids have been failures.

B. Poly-Chlorotrifluorethylenes (CTFE) A typical example is 'Fluorolube' made by the Hooker Chemical Company; an equivalent material is 'Flonlube', which is made in Japan. These are dense (c.1900 kg/cu.m) mobile liquids, miscible with many hydrocarbons and halogenated materials. They are chemically stable, biologically inert, non-flam mable and virtually odourless.

C. Fluorosilicones As normally supplied, these are viscous liquids of moderate (c. 1100 kg/cu.m) density, miscible with relatively few other liquids. Their other properties are similar to CTFE's.

In view of their attractive properties, such as high density, low viscosity, wide liquid range, high chemical stability and low biological activity, attempts have been made to use CTFE's in ER fluids. However, it is necessary to dilute them to bring their density down to a suitable range. Two series of diluents have been used up to now:

(1) Halogenated Materials. (as discussed above). These give highly active, density-matched ER fluids—the mixture with PCB is specifically claimed in an early patent—but naturally s uffer from all the difficulties of the halogenated diluent. Thus, the mixture with PCB is now illegal.

(2) Hydrocarbons There is no difficulty in making a mixture of hydrocarbon and CTFE with the correct density and other physical properties. However, it is found in practice that even small addition of hydrocarbon greatly reduces the activity of the final ER fluid.

The Use of Fluorosilicones in ER Fluids

Fluorosilicones do not appear to have been widely used as base liquids for ER fluids. Simple silicone oils have been tested; ER fluids based on them have similar properties to those based on hydrocarbons, namely poor density matching and low activity.

ER fluids based on undiluted commercial fluorosilicones are highly active, but unsuitable for practical use, since the base liquid is too viscous and has too low a density. Both these defects could in theory be reduced by mixing the fluorosilicone oil with CTFE. However, the commercial materials are immiscible at normal temperatures.

According to the present invention, there is provided an electro-rheological fluid comprising a hydrophilic solid and a hydrophobic liquid component wherein the hydrophobic liquid component comprises a fluorosilicone whose average molecular weight is in the range 200–700.

The basis of the present invention is the discovery that a reduction of the molecular weight of the fluorosilicone to the range indicated has two desirable effects:

It reduces the viscosity of the fluorosilicone itself.

II. It renders the fluorosilicone miscible with CTFE. Furthermore a mixture of low molecular weight (200–700) fluorosilicone (LMFS) with CTFE makes a virtually ideal base liquid for ER fluids, meeting all the criteria outlined above:

(1) The ER fluids made with this mixture are among the most active ever made.

(2) A mixture of approximately two parts of LMFS to one part of CTFE gives exact density matching with commonly used solids—minor adjustments may be necessary in some cases.

(3) Both materials are very stable chemically. CTFE has been known to explode in contact with aluminium or magnesium alloys under 'galling' conditions (e.g. in screw threads), but this can be avoided.

(4) Both materials have a very wide liquid range.

(5) CTFE will not burn at all; LMFS has a very high flashpoint, and can be considered non-flammable in normal use.

(6) The mixture has a low viscosity, of the order of 20 mPa.s.

(7) The mixture has virtually no effect on any of the normally used engineering materials, including the elastomers. Even with natural rubber, which is notoriously prone to attack by oils, swelling is barely perceptible.

(8) Both materials are good lubricants; vessels wetted with the mixture are likely to be dropped by inexperienced operators.

(g) Both materials are regarded as biologically inert.

(10) LMFS has no detectable odour; CTFE can be detected only with difficulty, and to all intents and purposes the mixture is odourless.

In summary, this mixture seems uniquely suited for use as the base liquid of ER fluids.

Chemical Aspects

Both materials are made by standard methods, well known from prior art; these methods of manufacture form no part of the present invention, which is concerned with the surprising benefits attainable by the use of the LMFS and mixtures of LMFS with other materials as base materials in ER fluids. The properties of two suitable materials are given in the Appendix by way of example only.

Preferably, the base liquid further comprises at least one further hydrophobic liquid selected from the group halogenated aromatic hydrocarbons (apart from derivatives of diphenyl methane and related diaryl materials and mixed aromatic ethers, both of which are claimed in earlier patents), halogenated aliphatic hydrocarbons or fluorinated polymers. The at least one further hydrophobic liquid may be a polymer of trifluorovinyl chloride. The density of the hydrophobic liquid component at 20 C. is preferably between 1200 and 1800 kg/cu.m. It is preferred for the solid component to comprise starch or silica gel. Alternatively the solid component may comprise an organic polymer containing free or at least partially salified acid groups. Yet again, the solid component may comprise a homo- or co-polymer of monosaccharide or other alcohol. Again, the solid component may comprise a co-polymer composed of a phenol, which may be wholly or partially salified, and an aldehyde.

Irrespective of its nature, the volume fraction of the solid comonent is preferably from 20% to 60% by volume. Furthermore, the hydrophilic solid is preferably in the form of particles having diameters in the range 1 to 50 microns.

Below are properties of typical materials, given by way of example only.

Low Molecular Weight Fluorosilicone (LMFS)

| Suppliers Designation: | | | FSO/181264 | | | |
|---|---|---|---|---|---|---|
| Appearance | | | Colourless, clear liquid | | | |
| Odour | | | Nil | | | |
| Viscosity | at 25° C. | | 19.8 mm/sec (23.4 mPa.s) | | | |
| Refractive Index | " | | 1.3744 | | | |
| Density | " | | 1180 kg/cu.m | | | |
| Chlorine Content | | | Approx 2 ppm | | | |
| Pour Point | | | below −70° C. | | | |
| Flash Point | | | 103° C. | | | |
| Fire Point | | | 360° C. | | | |
| Vapour Pressures: | | | | | | |
| Temp (°C.) | 20 | 50 | 70 | 100 | 150 | 200 |
| Pressure (Torr) | 0.017 | 0.13 | 0.43 | 1.9 | 14.7 | 73.4 |
| Pressure (mBar) | 0.023 | 0.18 | 0.56 | 2.5 | 19.5 | 97.2 |
| Volatility: | | | | | | |
| (10g in 50 ml cup at 200° C. for 4 hrs.) | | | | | | 19% |

Composition:

The material is a mixture of linear and cyclic polysiloxanes, primarily methyl trifluoropropyl siloxanes. The linear chains have trimethylsilyl end groups. The cyclic polysiloxanes consist mainly of cyclotetrasiloxanes, with cyclotri-,cyclopenta- and cyclohexasiloxanes.

Poly-chlorotrifluorethylene

The material described below is 'Flonlube' FL-500, supplied by the Asahi Glass Company, Japan. An equivalent material, designated Fluorolube FS-5, is available from Hooker Chemical Corporation U.S.A.

| | | |
|---|---|---|
| Density | at 25° C. | 1840 kg/cu.m |
| Viscosity | " | 9 mPa.s |
| Pour Point | | below −70° C. |
| Molecular Weight | | 500–1000. |
| Odour | | Trace |
| Flammability | | Does not burn |

(N.B. Thermal decomposition may occur at very high temperatures)

What I claim is:

1. An electro-rheological fluid comprising a hydrophilic solid and a hydrophobic liquid component wherein said hydrophobic liquid component comprises a fluorosilicone whose average molecular weight is in the range 200–700.

2. An ER fluid as claimed in claim 1 comprising a mixture of low molecular weight (200–700) fluorosilicone (LMFS) with a poly-chlorotrifluorethylene (CTFE).

3. An ER fluid as claimed in claim 2 comprising approximately two parts of LMFS to one part of CTFE.

4. An ER fluid as claimed in claim 1, further comprising at least one further hydrophobic liquid selected from the group halogenated aromatic hydrocarbons (apart from derivatives of diphenyl methane and related diaryl materials and mixed aromatic ethers), halogenated aliphatic hydrocarbons or fluorinated polymers.

5. An ER fluid as claimed in claim 4, wherein the at least one further hydrophobic liquid is a polymer of trifluorovinyl chloride.

6. An ER fluid as claimed in claim 1, wherein the density of said hydrophobic liquid component at 20° C. is between 1200 and 1800 kg/cu.m.

7. An ER fluid as claimed in claim 1, wherein said solid component comprises starch.

8. An ER fluid as claimed in claim 1, wherein said solid component comprises silica gel.

9. An ER fluid as claimed in claim 1, wherein said solid component comprises an organic polymer containing free salified acid groups.

10. An ER fluid as claimed in claim 1, wherein said solid component comprises an organic polymer containing at least partially salified acid groups.

11. An ER fluid as claimed in claim 1, wherein said solid component comprises a homo-polymer of monosaccharide or other alcohol.

12. An ER fluid as claimed in claim 1, wherein said solid component compries a co-polymer of monosaccharide.

13. An ER fluid as claimed in claim 1, wherein said solid component comprises a homo-polymer of an alcohol other than monosaccharide.

14. An ER fluid as claimed in claim 1, wherein said solid component comprises a co-polymer of an alcohol other than monosaccharide.

15. An ER fluid as claimed in claim 1, wherein said solid component comprises a co-polymer composed of a phenol, and an aldehyde.

16. An ER fluid as claimed in claim 15, wherein said phenol is wholly salified.

17. An ER fluid as claimed in claim 15, wherein said phenol is partially salified.

18. An ER fluid as claimed in claim 1, wherein the volume fraction of said solid component is from 20% to 60% by volume.

19. An ER fluid as claimed in claim 1, wherein said hydrophilic solid is in the form of particles having diameters in the range 1 to 50 microns.

* * * * *